US005435383A

United States Patent [19]

Rajagopal

[11] Patent Number: 5,435,383

[45] Date of Patent: Jul. 25, 1995

[54] PLATE HEAT EXCHANGER ASSEMBLY

[76] Inventor: Ramesh Rajagopal, No. 8, 4th Cross Street Ormes Road, Kilpauk Madras - 600 010, India

[21] Appl. No.: 190,670

[22] Filed: Feb. 1, 1994

[51] Int. Cl.[6] ..... F28F 3/08

[52] U.S. Cl. ..... 165/167; 165/166

[58] Field of Search ..... 165/166, 167, 153

[56] References Cited

U.S. PATENT DOCUMENTS

| | | | |
|---|---|---|---|
| 2,075,236 | 3/1937 | Seligman et al. | 165/167 |
| 2,281,754 | 5/1942 | Dalzell | 165/167 |
| 2,777,674 | 1/1957 | Wakeman | 165/167 |
| 3,444,926 | 5/1969 | Stalberg | 165/166 |
| 4,653,581 | 3/1987 | Yogo et al. | 165/166 |
| 4,696,341 | 9/1987 | Bolmstedt et al. | 165/166 X |
| 4,700,770 | 10/1987 | Bolmstedt et al. | 165/166 X |
| 4,967,835 | 11/1990 | Lefeber | 165/167 |

FOREIGN PATENT DOCUMENTS

| | | | |
|---|---|---|---|
| 337751 | 4/1919 | Germany | 165/174 |
| 366869 | 8/1919 | Germany | 165/153 |
| 730039 | 12/1942 | Germany | 165/173 |
| 245093 | 10/1987 | Japan | 165/170 |
| 86492 | 3/1992 | Japan | 165/167 |
| 115938 | 3/1946 | Sweden | 165/167 |

*Primary Examiner*—John Rivell
*Assistant Examiner*—L. R. Leo
*Attorney, Agent, or Firm*—Ladas & Parry

[57] ABSTRACT

A plate heat exchanger assembly having a plurality of corrugated metal members between two end cover metal members and interspaced with gasket members. The corrugated metal members have corrugations establishing a network of contact points and forming turbulent channels for heat exchange between two fluids flowing counter-currently in and out through at least four ports. Each of the corrugated metal members, end cover metal members and gasket members have at least four corner portholes in alignment with corresponding portholes. Each gasket member has two through portholes and two communicating portholes. Clamping means pass through each aligned porthole for clamping each of the four ports on either side of the plate heat exchanger assembly to bind individual ports. The clamping means have end connections and openings at predetermined positions and communicate with desired channels having flow through medians provided around inlet and outlet porthole portions permitting flow of fluids in and out while sealing adjacent channels 360 degrees all around at each port against intermixing.

3 Claims, 4 Drawing Sheets

PLATE HEAT EXCHANGER ASSEMBLY

SUMMARY OF INVENTION

The improved plate heat exchanger assembly according to this invention comprises a plurality of corrugated metal members, between two end cover metal members and interspaced with gasket members. The corrugations establishing a network of contact points, and forming channels for turbulent flow of fluids requiring heat exchange. Each of the above said members, having four corner portholes in alignment with the corresponding porthole of the adjacent gasket member, in such a way that the two heat transfer media, flow counter-currently there-through. The said plate heat exchanger assembly is sealed specifically against intermixing of both fluids, with a hollow cylindrical metal member for clamping each port on one side of the assembly, with the other side of the assembly, thereby binding individual ports, the said cylindrical member having suitable openings in communication with desired channels, and by providing flow through medians around inlet and outlet portions of desired channel. The flow through medians, while permitting fluids to enter and exit the desired channels, from and to the cylindrical members, press the corrugated members rigidly against the adjacent gasket members, thereby ensuring a 360 degree seal all around at each adjacent/alternate channel at each port, to prevent intermixing of fluids at these critical junctions, where intermixing can take place. The said assembly is sealed around the external periphery for preventing both the fluids from leaking externally to the atmosphere, after vacuum testing for intermixing.

The present invention has been developed after a careful study of the existing plate heat exchangers. In order to facilitate better understanding of the present invention, plate heat exchangers known in the art are described hereunder:

PLATE HEAT EXCHANGERS comprise of corrosion resistant sheet metal plates having a corrugated surface. A plurality of such plates are stacked and clamped together between two rigid end plates. Numerous contact points established between the adjacent plates give high turbulance to the fluid flowing therethrough resulting in high heat transfer co-efficient. These plates are provided with portholes for the passage of two media between which heat transfer takes place. The assembly is sealed together peripherally with gaskets. The portholes are also provided within gaskets to direct the medium flowing therethrough to the selected alternate channels. U.S. Pat. No. 5,226,474 describes such a plate heat exchanger with a high heat exchange efficiency. U.S. Pat. No. 4,872,506 describes a gasket system for such plate heat exchangers.

PLATE HEAT EXCHANGERS WITH DOUBLE WALL STRUCTURE consist of a plate pack in which welded channels alternate with gasketed channels. Welded channels are formed by welding together the reverse side of two plate grooves to each other. Welded plate pair is provided with portholes having gaskets made of highly corrosion resistant elastomer. Such plate heat exchangers are advantageously used where the aggressive fluid flows through the welded channels. The channels containing the non-aggressive secondary fluid are sealed by elastomeric gaskets. The whole assembly is clamped between two rigid end plates. U.S. Pat. No. 4,976,313 disclose such a plate heat exchanger which allow a leakage of either of the two fluids to escape to atmosphere so as to avoid contamination of the other fluid, and having a high heat exchange efficiency. U.S. Pat. No. 5,178,207 describes another such exchanger with high efficiency and at same time with provision to detect a leakage quickly.

PERMANENTLY JOINED PLATE HEAT EXCHANGERS are described in U.S. Pat. No. 4,987,955 wherein a plate heat exchanger comprising of a series of corrugated plates are permanently joined to each other along their peripheral portions, and at a variety of places in their heat exchange portion in such a manner that they leave flow passage between adjacent heat exchange plates for flow of two fluids. This type of heat exchanger has a robust construction to withstand high pressure and temperature of heat exchange fluids. A pack of such plates is provided with two end plates with portholes for the two fluids to flow counter currently.

ALL WELDED PLATE HEAT EXCHANGERS are described in technical literature of TRANTER INC, Texas, USA, wherein all the heat exchange plates, are permanently joined by welding completely together around the periphery, between end plates, and in alternate channels at the outlet-/inlet ends, and connections, thereby sealing the entire unit against intermixing and external leakage. Channels formed between the welded plates and end connections direct the two heat transfer media counter-currently through alternate channels for heat exchange. This is a robust heat exchanger capable of withstanding high service temperature and pressure.

In all types of heat exchangers two types of leakage can occur, if there is any failure in sealing either by gaskets or by permanent joining. One is an external leak where the fluids leak out to the atmosphere, this can be visibily detected and corrected. The other type is internal leakage or intermixing of fluids, which is very critical and cannot be detected easily when the leakage is in very small quantities. Intermixing of fluids occur at porthole junctions where the fluids enter or exit the desired channels, if sealing at these junctions are improper, the fluids enter into undesired channels and/or exit into undesired ports, causing intermixing. Hence it is essential that the heat exchangers have adequate safety of sealing against intermixing.

It is to be noted that in most of the hitherto known plate heat exchangers, other than permanently joined plate heat exchanger and all welded plate heat exchanger, portholes and peripheral portions are mostly sealed with elastomeric gaskets and the entire clamping is done around the periphery, between two rigid end plates, wherein the end plates have to be sufficiently thick to seal all the porthole junctions, the peripheral edges and contain the pressure of the fluids. It is also necessary when using such heat exchangers that the gaskets when compressed/tightened at all extreme ends between rigid end plates, get good sealing all around portholes and also at the peripheral ends, because the same tightening means determines sealing at all these places.

Moreover in such heat exchangers there are greater possibility of intermixing of fluids at portholes, when the pressure and temperature greatly vary between two fluids.

The permanently joined and all welded plate heat exchangers seal very efficiently against intermixing and external leakage of both fluids, but are comparatively expensive and are not easily serviceable. Also these types of plate heat exchangers are limited to comparatively smaller sizes due to their method of permanent joining.

Hence the object of this invention is to eliminate and overcome the inherent draw backs of the conventional plate heat exchangers hitherto known in the art, and to provide a simple and reliable method of heat transfer between two fluids, at low cost.

These objectives are met by eliminating elastomeric gaskets and by having means specifically for preventing intermixing between fluids and the assembly being simplified for a wide range of sizes at lower costs. In addition the said assembly can be checked for intermixing of fluids, by application of vacuum before final sealing of external leaks, by permanent joining of the external periperhery.

The invention will be better understood with reference to the following drawings and description of the preferred embodiment.

DETAILED DESCRIPTION OF THE PREFERRED EMBODIMENT

Figure 1:
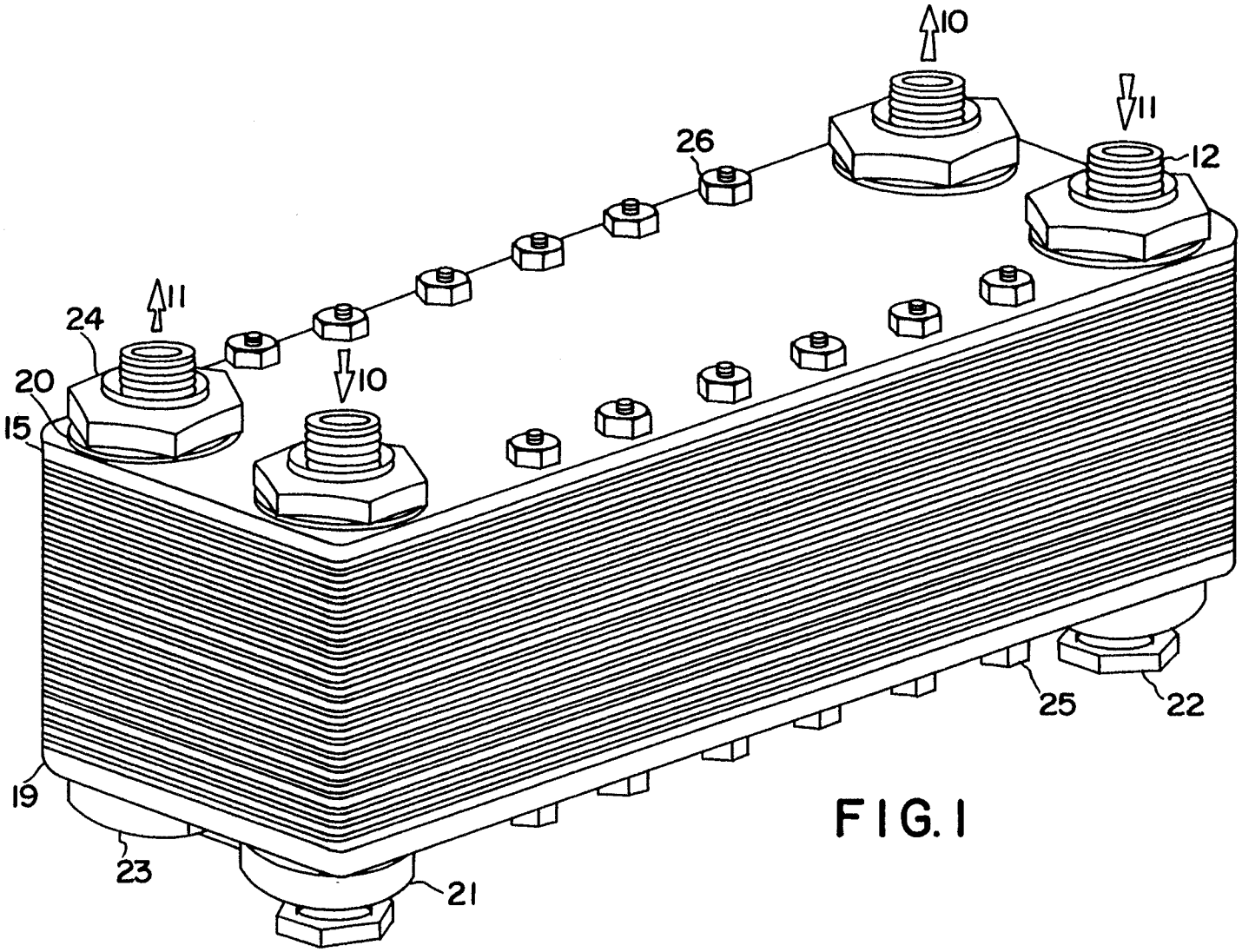
FIG. 1 is a perspective view of the improved plate heat exchanger assembly which embodies the principles of this invention.

FIG. 1 is a perspective view of the preferred embodiment consisting of two end plates 15 and 19, and in between a series of plates, being bound at the four corner on both ends by large headed bolts 21 and 23 and nuts 24. The nut 24 end consist of four threadings 12 for connection of inlet and outlet ports of the two fluids 10 and 11 flowing counter-currently, the longer peripheral ends being held together with nuts 26 and bolts 25.

Figure 2:
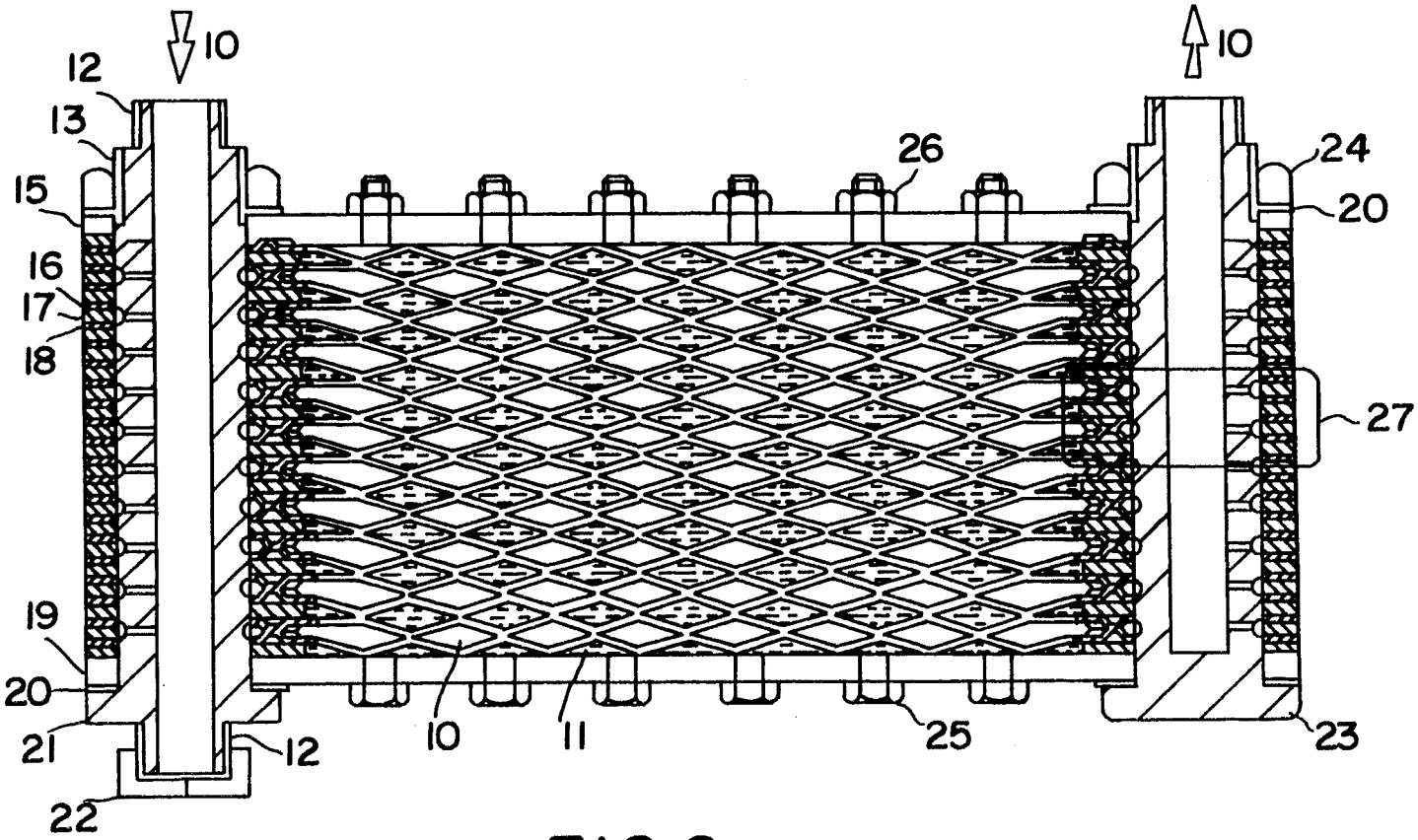
FIG. 2 is a sectional view of FIG. 1 at the inlet, and outlet ports of fluid 10.

FIG. 2 is a sectional view of FIG. 1. The plate heat exchanger of this invention consists of a plurality of corrugated metal members 16 and 18, preferably stainless steel/corrosion resistant material forming part of the assembly. The other member 17 is made from a gasket material such as aluminium or copper and is integral in the shape of a frame or spacer and is positioned between two corrugated members 16 and 18. The gasket member 17 has contacts only with the borders around portholes and the outer peripheral area of the corrugated members 16 and 18. This assembly may have a series of such corrugated members, alternating with gasket members, which is housed between two end cover metal members 15 and 19. This end cover member may be of stainless steel/corrosion resistant material. When joined together the gasket member 17 between each of the end cover member and corrugated member act not only as a gasket to help in rigidly sealing the assembly, but also as a spacer, without in any way hindering the contact of the corrugations in the corrugated members adjacent to each other. The corrugations in the members 16 and 18 establish a network of contact points and form necessary turbulent channels for flow of the two fluids requiring heat exchange.

Each of the corrugated member 16, 18 and the end cover members 15 and 19 are provided with inlet and outlet through portholes for flow of both fluids 10 and 11. The gasket member 17 has two through portholes, and two communicating portholes which are connected to the inside of the hollow frame for flow of media. A pair consisting of a through porthole and a communicating porthole are located at either ends of the gasket member. The same gasket member 17 is reversed alternatively between the corrugated members 16 and 18 to provide counter-current flow.

Each of the four portholes on each of the corrugated member, the end cover member, and the gasket member alternating in between, are clamped/sealed individually by clamping means comprising of a hollow cylindrical metal member 21 or 23 passing therethrough. The cylindrical member may be made of stainless steel/corrosion resistant material.

The cylindrical member 21, 23 passing though the portholes are provided with suitable openings 30, 31 to allow flow of fluids into the channels. Also these cylindrical members are provided a chamfered head or provision for non-rotation at one end and threadings 13 at the other end. These four cylindrical members bind rigidly between their chamfered end and threaded 13 end, all the said members at each port, with gasket washers 20 and nuts 24. The chamfered end prevents rotation of the member while tightening with nuts 24. Also the four cylindrical members 21, 23 beyond their chamfered end and threaded 13 end are provided with suitable threadings 12 on either 21 or on one end 23 for connecting the inlet or outlet port of each fluid such that, the inlet or outlet port connection for each fluid can be taken at either one and/or both ends of the assembly as needed. Nut 22 is used for closing unused connections. The external edges are sealed by bolts 25 and nuts 26 around the periphery.

Figure 3:
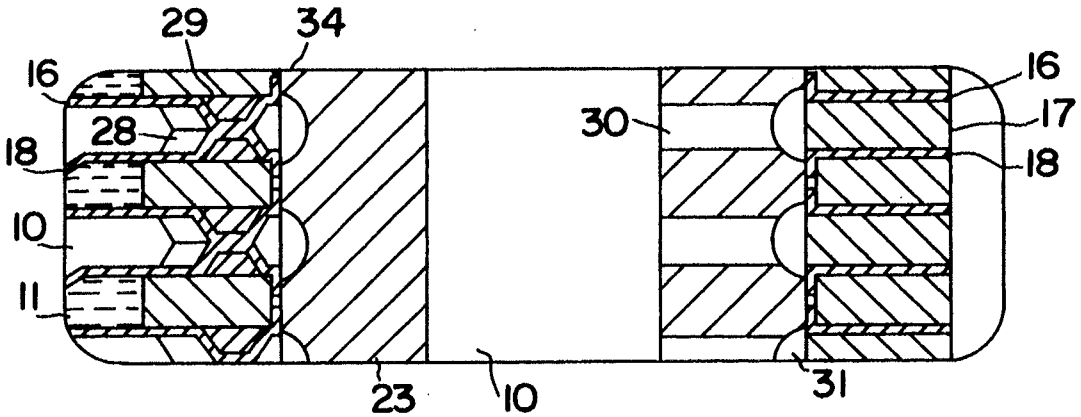
FIG. 3 is a detail view of 27 of FIG. 2
Figure 5:
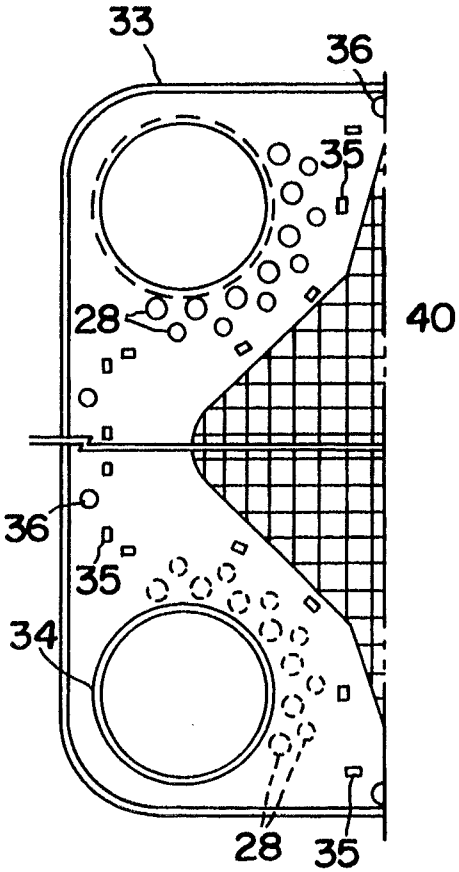
FIG. 5 is a plan view of one end of a large corrugated member.

In the embodiment of the invention the flow through medians comprise of a series of pips/projections 28 on the corrugated members 16 and 18 arranged radially along the rim 34 of the portholes corresponding to the opening of the communicating portholes of gasket member 17. The second row of pips/projections are arranged radially, each slightly above the gap between two consecutive pips/projections of the inner radial row. In FIG. 5 the plan view of the series of pips/projections 28, is shown. FIG. 3 is a detail view of 27 of FIG. 2 wherein the elevation of pips/projections 28 on the corrugated members 16 and 18 around the fluid 10 exit area of desired channel or channel requiring flow through is shown. These pips/projection 28 while permitting flow of fluid 10 from desired channels into fluid 10 outlet port at cylindrical member 23, press corresponding pips/projections 28 on both the corrugated members 16 and 18 rigidly against, the through porthole portions of adjacent gasket members 17, such that a 360 degree seal is effected all around and prevents fluid 11 from adjacent channels to enter the outlet port of fluid 10 at cylindrical member 23, and also prevents fluid 10 and 11 from entering corresponding undesired channels. Thereby in total the pips/projections 28 while permitting flow through of fluids 10 and 11 in and out of desired channels prevent intermixing of fluids 10 and 11 at adjacent channel inlet and/or outlet porthole portions at each port. In addition the cylindrical members 21 and 23 support the rim 34 of the portholes on the corrugated members 16 and 18, and thereby protecting the pips/projections 28 from collapsing inside when all the members are joined together rigidly.

These flow through medians comprising of pips/projections 28 as described earlier are filled on the rear of each, with reinforcer members 29 to prevent buckling of pips and projections 28, when the assembly is tightened with cylindrical members 21 or 23. The reinforcer members 29 may be made of high compressive strength materials such as stainless steel, non-ferrous metals, rigid engineering plastics or rigid setting compounds. These reinforcer members 29 hold the series of pips/-projections 28 on the corrugated members 16 and 18 rigidly pressed against the adjacent gasket members 17 and help in maintaining rigidity of 360 degree seal of alternate channels in each port, even under extreme conditions of pressure and temperature as needed for special application.

Figure 4:
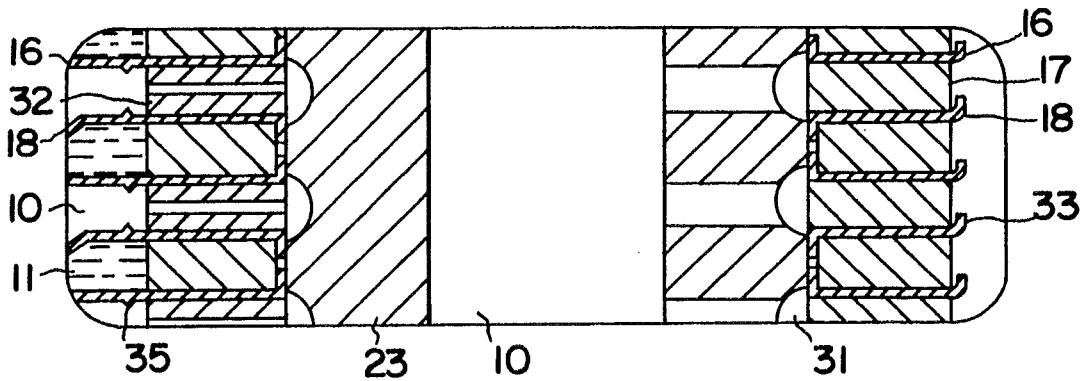
FIG. 4 is an alternate detail view of 27 of FIG. 2.

In another embodiment of this invention, FIG. 4 is an alternate detail of 27 of FIG. 2 wherein the flow through medians comprise of a part of an annular metal member 32, located around the fluid 10 exit area of desired channel requiring flow through between two corrugated members 16 and 18 and on the communicating porthole area of gasket member 17, and consist of a plurality of holes provided across its annular width. This member 32 while permitting flow of fluid 10 through desired channel into fluid 10 outlet port at cylindrical member 23, press both the corrugated member 16 and 18 rigidly against the through porthole portions of adjacent gasket member 17 to effectively seal 360 degree all around, to prevent fluid 11 to enter outlet port of fluid 10 at cylindrical member 23 and also prevent fluids 10 and 11 from entering undesired channels. Thereby in total the annular member 32, while permitting flow through of fluids 10 and 11 in and out of desired channels, prevent intermixing of fluids 10 and 11 at adjacent channels at each port. When the embodiment with flow through medians comprising of annular member 32 is used the series of pips/projections 28 are not present on corrugated metal members 16 and 18. The part annular member 32 may be made of corrosion resistant/stainless steel materials.

Figure 6:
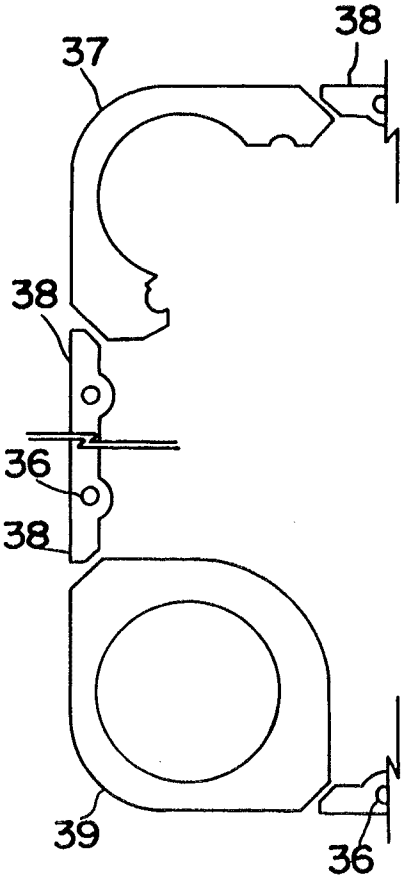
FIG. 6 is a plan view of one end of a gasket member, comprising a plurality of units corresponding to the corrugated member of FIG. 5.

In large plate heat exchangers the gasket member 17 is made from a plurality of individual units. FIG. 6 shows such lay out of a gasket member 17 at one end comprising a plurality of units, corresponding to the communicating porthole 37, through porthole 39, and the perpheral units 38. Holes 36 are provided on peripheral units 38, for bolting down at peripheral edges. The external junctions formed by the plurality of units are brazed or welded to seal for external leak after full assembly. When the width of plate heat exchanger is smaller compared to its length, each end of gasket member 17 is an integral unit comprising of one through porthole, one communicating porthole and the periphery comprised of a plurality of peripheral units 38. The gasket member 17 can be made either as an integral or non-integral unit, with a wide range of gasket materials having essentially lower compressive strength than the corrugated members, such as soft metals like aluminium, copper etc., or engineering plastic materials, depending on the fluids used and sizes of heat exchangers required. For plate heat exchangers requiring a higher gap between adjacent corrugated plates 16 and 18 the gasket member 17 can be made of three layers, where the thinner top and bottom layers are made of gasket material and the middle layer made of a hard metal member and the total thickness of the three layers corresponding to the required higher gap.

FIG. 5 is one end of a corrugated member corresponding to the gasket member in FIG. 6, with suitable corrugations on heat exchange area 40. The external rim 33 all round the corrugated member acts as an external location and support for the gasket member 17, comprising of units 37, 38 and 39. Projections 35 act as an internal location and support for the gasket member pieces 37, 38 and 39 and also for annular member 32 when used. Rim 34 is provided around each porthole, rim direction corresponding to fit inside through portholes of gasket member 17, located between two corrugated members 16 and 18. The series of pips/projection 28 on the corrugated member locate around the communicating porthole 37 of gasket member 17.

Figure 7:
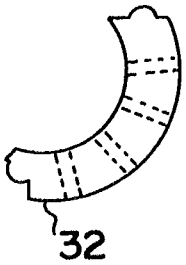
FIG. 7 is a plan view of a flow through median comprising of a part of an annular sheet metal member.

FIG. 7 is a plan view of an annular member 32. The size and shape of this member is such that when placed on the open area of communicating porthole 37 of the gasket member 17, completes the 360 degree circle around each channel requiring flow in or out. When member 32 is used, the pips/projections 28 are not present on corrugated members.

Plate heat exchangers of this invention can be provided with thinner end cover members, since all ports are bound rigidly at either ends and only the pressure of fluids in heat exchange area has to be contained, and this pressure can be transfered to on and/or outside its peripheral edges by support means provided across the assembly.

The assembly of plate heat exchanger after adequate tightening of each of the four cylindrical members 21 and/or 23 with nuts 24, is checked for intermixing before sealing for external leaks if permanent sealing, such as brazing or welding is adopted to seal peripheral edges. Vaccum is connected to the inlet port of fluid 10 and the corresponding outlet port connected to a vacuum gauge. The other two ports for the fluid 11 is kept open. When vacuum is applied and held, the external edges are temporarily closed by placing a rubber sheet all around. If vacuum holds on the gauge there is no intermixing. The same procedure is adopted for the other pair of ports of fluid 11 before permanent sealing of periphery is done.

Hence it is to be noted that provision of gasket members made of materials with lower compressive strength than the corrugated members, individual port binding by clamping means with flow through medians as described earlier to prevent intermixing and vacuum testing for intermixing before final peripheral edge sealing, are the innovative features of this invention.

This invention has been described and illustrated herein above with reference to a particular embodiment. It is to be understood, that obvious equivalents and variations known to persons skilled in the art are possible within the scope and ambit of the appended claims.

I claim:

1. A plate heat exchanger assembly comprising a plurality of corrugated metal members, between two end cover metal members and interspaced with gasket members, the corrugated metal members having corrugations establishing a network of contact points and forming turbulent channels for heat exchange between two fluids flowing counter-currently in and out through at least four ports, each of said plurality of corrugated members, said end cover metal members and said gasket members having at least four corner portholes in alignment with corresponding portholes, wherein each of said gasket members has two through portholes and two communicating portholes, clamping means passing through each of said corner portholes in alignment for clamping each of the four ports on either side of the plate heat exchanger assembly to bind individual ports, said clamping means having end connections and openings at pre-determined positions in communication with desired channels having flow through medians provided, said flow through medians including a plurality of pips/projections on each of adjacent corrugated metal members around inlet and outlet porthole portions corresponding to an opening on the communicating portholes of the gasket members, said pips/projections, while permitting flow through of fluids, press said adjacent corrugated metal members rigidly against through porthole portions of adjacent gasket members, sealing adjacent channels 360 degrees all around to prevent intermixing of fluids at each port, said plate heat exchanger assembly being permanently joined and/or bolted around its peripheral edges to prevent external leakage after vacuum testing for intermixing, wherein the pips/projections on the corrugated metal members, are rearwardly filled by reinforcer members from high compressive strength materials.

2. A plate heat exchanger assembly comprising a plurality of corrugated metal members, between two end cover metal members and interspaced with gasket members, the corrugated metal members having corrugations establishing a network of contact points and forming turbulent channels for heat exchange between two fluids flowing counter-currently in and out through at least four ports, each of said plurality of corrugated metal members, said end cover metal members and said gasket members having at least four corner portholes in alignment with corresponding portholes, wherein each gasket member has two through portholes and two communicating portholes, clamping means passing through each of said corner portholes in alignment for clamping each of the four ports on either side of the plate heat exchanger assembly to bind individual ports, said clamping means having end connections and openings at predetermined positions in communication with desired channels having flow through medians provided around inlet and outlet porthole portions permitting flow of fluids in and out while sealing adjacent channels 360 degrees all around at each port against intermixing, said assembly being permanently joined and/or bolted around its peripheral edges to prevent external leaks, after vacuum testing for intermixing, wherein the clamping means for clamping individual ports at either ends is a hollow cylindrical metal member containing a head end with a provision for non-rotation and threadings at an opposite end, wherein beyond the head end and/or on the opposite end, connecting means are provided for fluid entry or exit, said cylindrical metal member having openings for flow of fluids in or out of channels.

3. A plate heat exchanger assembly comprising a plurality of corrugated metal members, between two end cover metal members and interspaced with gasket members, the corrugated metal members having corrugations establishing a network of contact points and forming turbulent channels for heat exchange between two fluids flowing counter-currently in and out through at least four ports, each of said plurality of corrugated members, said end cover metal members and said gasket members having at least four corner portholes in alignment with corresponding portholes, wherein each of said gasket members has two through portholes and two communicating portholes, clamping means passing through each of said corner portholes in alignment for clamping each of the four ports on either side of the plate heat exchanger assembly to bind individual ports, said clamping means having end connections and openings at predetermined positions in communication with desired channels having flow through medians provided, said flow through medians including a plurality of pips/projections on each of adjacent corrugated members around inlet and outlet porthole portions corresponding to an opening on the communicating portholes of the gasket members, said pips/projections, while permitting flow through of fluids, press both said adjacent corrugated members rigidly against through porthole portions of adjacent gasket members, sealing adjacent channels 360 degrees all around to prevent intermixing of fluids at each port, said plate heat exchanger assembly being permanently joined and/or bolted around its peripheral edges to prevent external leakage after vacuum testing for intermixing, wherein the clamping means for clamping individual ports at either ends is a hollow cylindrical metal member containing a head end with a provision for non-rotation and threadings at an opposite end, wherein beyond the head end and/or on the opposite end, connecting means are provided for fluid entry or exit, said cylindrical metal member having openings for flow of fluids in or out of channels.

* * * * *